United States Patent [19]

Ullenboom

[11] Patent Number: 4,603,984

[45] Date of Patent: Aug. 5, 1986

[54] APPARATUS AND METHOD FOR THE REDUCTION OF PRINTING OFFSET IN BIDIRECTIONAL PRINTING DEVICES

[75] Inventor: Hermann Ullenboom, Deisenhofen, Fed. Rep. of Germany

[73] Assignee: Siemens Aktiengesellschaft, Berlin & Munich, Fed. Rep. of Germany

[21] Appl. No.: 666,735

[22] Filed: Oct. 31, 1984

[30] Foreign Application Priority Data

Nov. 3, 1983 [DE] Fed. Rep. of Germany ..... 3339787

[51] Int. Cl.[4] ..... B41J 3/12

[52] U.S. Cl. ..... 400/121; 400/322; 400/323

[58] Field of Search ..... 400/121, 124, 323, 322; 101/93.04, 93.05

[56] References Cited

U.S. PATENT DOCUMENTS 3,970,183 7/1976 Robinson et al. ..... 400/65 X

*Primary Examiner*—Paul T. Sewell

*Attorney, Agent, or Firm*—Hill, Van Santen, Steadman & Simpson

[57] ABSTRACT

A bidirectional dot-matrix printer compensates for dislocations of the location of the last print clock with printed information on a printed line by producing at least one further print clock after the end of the printing information, and initiating breaking of the printer carriage after such dummy print clocks. During movement of the print head in the reverse direction on the subsequent line, the dummy print clocks are taken into consideration before initiating print clocks which are coincident with printed information.

4 Claims, 3 Drawing Figures

APPARATUS AND METHOD FOR THE REDUCTION OF PRINTING OFFSET IN BIDIRECTIONAL PRINTING DEVICES

BACKGROUND OF THE INVENTION

1. Field of the Invention

The present invention relates to an apparatus and method for the reduction of printing offset in a bidirectional printing device, for example a dot-matrix printer.

2. Prior Art

Print heads for dot-matrix printers comprise printing elements such as needles, which are arranged in one or a plurality of rows. The individual needles or print elements are driven in accordance with information derived from a character generator, to result in printing a column of dots. Characters are formed out of successive dot columns. A column and print clock is supplied to the print head after the print head is moved by a column spacing, between successive columns for time purposes. The print clock defines the point in time in which the print elements are actuated.

Actuation of the printing elements always occurs during the movement of the print head at constant velocity. The formation of the print clock results by sensing movement of the carriage upon which the print head is mounted, or alternatively by sensing the drive means which moves the printer carriage. Specifically, the print clock signals are derived from scan clock signals which are typically produced by sensing movement of an optical timing disk or timing ruler. A so-called PLL module can be employed to derive the scan clocks from the timing disk or timing ruler, with the module producing an output clock signal of higher frequency in a predetermined phase relationship with the timing disk or timing ruler. The output clock signals are supplied to a print clock generator for the formation of the print clock signal.

In known apparatus this generation of the print clock signals enables columns of characters, and entire printing lines to be defined by means of counting the cycles of the print clock signal, beginning at the start of the line. The motion of the printer carriage must be decelerated at the end of a line and subsequently accelerated in the opposite direction. Since the print clock signals are only available during movement of the printer carriage, which occurs with instant velocity, the scan clock signal must be consulted during deceleration and acceleration, instead of the print clock signal. However this sometimes leads to errors in the form of a printing offset or mismatch, which can occur at the end of a printing event that is when switching from counting the printing clock cycles to counting the scan clock cycles. Such errors may be caused by mechanical characteristics such as stretching of the belt of a belt drive, or the flight time of the needles for dot-matrix printers with wire matrix print heads, or unavoidable tolerances of component parts.

As a result of these factors, it sometimes occurs that the last print clock signal lies immediately adjacent the edge of a scan clock signal, so that a time ambiguity of one scan clock cycle can occur. This then leads to the printing offset error mentioned above and to a poor print appearance. This result is particularly disadvantageous in connection with bidirectional printers, that is, printers which prints successive lines and two opposite directions.

BRIEF DESCRIPTION OF THE INVENTION

A principal object of the present invention is to provide an apparatus and method for avoiding printing offset errors, especially in the case of bidirectional printers. This object is achieved in the present invention by providing a dummy print clock after the time of the last print clock signal of a printed line, and the braking of the printer carriage is initiated after the additional print clock signal. The additional print clock is also taken into consideration in the formation of the first print clock coincident with printing information after the reversal of direction of the printer carriage.

These and other objects and advantages of the present invention will become manifest via an inspection of the following description and the accompanied drawings.

BRIEF DESCRIPTION OF THE DRAWINGS

Reference will now be made to the accompanying drawings in which.

DESCRIPTION OF THE PREFERRED EMBODIMENT

Figure 1:
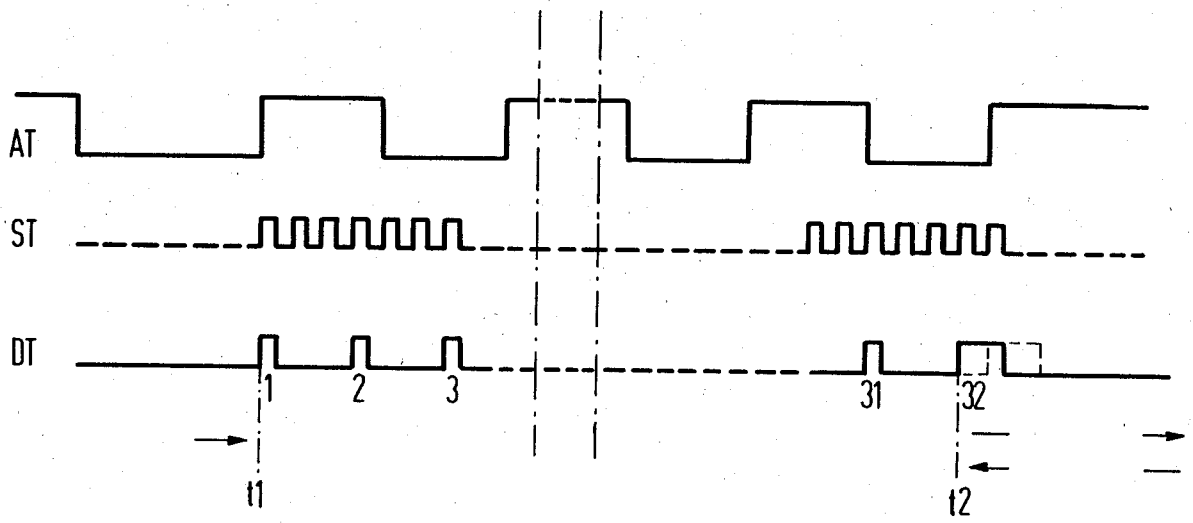
FIG 1 PRIOR ART
FIG. 1 is a graph showing print clock signals of a dot-matrix printer according to the prior art.

Referring now to FIG. 1, a graph is shown of print clock signals in a dot-matrix printer having a scan clock AT, a control clock ST, and a print clock DT. Each signal comprises rectangular pulses, which are formed as a result of motion of a printer carriage carrying the print head along a printing line. The scan clock AT is typically formed by sensing movement of the printer carriage or by sensing the timing disk connected to the drive for moving the printer carriage, for example the drive motor. During the acceleration phase, the frequency of the scan clocks AT increases continuously until the carriage has reached the constant velocity required for printing. The time at which the printer carriage achieves the desired velocity, and the position of the printer carriage at this time, is determined in known fashion by means of counting the scan clocks in a counter.

It is also possible to identify the position of the printer carriage at this time by means of a switch which detects the printer carriage when it reaches the position corresponding to the beginning of a line. In the example of FIG. 1, the acceleration phase is completed at time t1. Defined control clock signals ST are available after time t1, and these are generated by means of a known PLL (phase look loop circuit). In the example of FIG. 1, the control clock has a frequency that is the multiple of eight times the frequency of the scan clock AT. The print clock DT is formed by means of dividing the control clock signals by a factor of 3. The column clocks for the print head which are required for printing a character in a printing line, are generated during the printing phase, and in the example FIG. 2 it is assumed that 32 column clocks are required for the representation of each character. Accordingly, the print clock DT32 of the last character in a line is also the last print clock of the line. In the example of FIG. 1 this occurs at time t2. Following the time t2, the leading edge of the next successive scan clock AT is interpreted for the initiation of the braking phase of the printer carriage. During the braking, a pluralty of scan clocks AT are counted. The above events are repeated in the return direction for the next line, with an acceleration in the opposite direction after the carriage has been braked to a stop. When the printer carriage again reaches the prescribed speed, the print clocks for printing in the return direction are produced.

Due to deviations in the timing of the control clocks ST and the print clocks DT, which are caused by component tolerances or deviations in the sensing of a timing disk or, by mechanical characteristics of the drive elements, the last print clock DT32 can appear in the immediate proximity of an edge of the scan clock AT. It can lie shortly before this leading edge or shortly after it. This produces an error for a duration of up to one clock period of the scan clock in switching from counting the print clocks to counting the scan clocks. This error is expressed in a clearly visible print offset or mismatch of printing on successive lines, and the printed image has a very irregular appearance. This can sometime lead to a loss of information over a number of lines, especially when the printing events lie outside the boundaries of the recording medium.

FIG. 1 illustrates in dashed form a shifted position of the last print clock DT32. In that case, the printer carriage would continue to run with constant speed even during the scan clock following the last printing pulse and the braking operation would be delayed by an entire scan clock period.

In accordance with the present invention, one or more additional print clocks, which are sometimes referred to herein as dummy print clocks, are generated following the last real print clock, with the result that the last of these print clocks has an adequately large spacing from the leading or trailing edge of the next scan clock which is used as an interpretation edge (to initiate braking). The same conditions are then valid for the interpretation of the following scan clock for all lines, to eliminate the printing offset referred to above.

Figure 2:
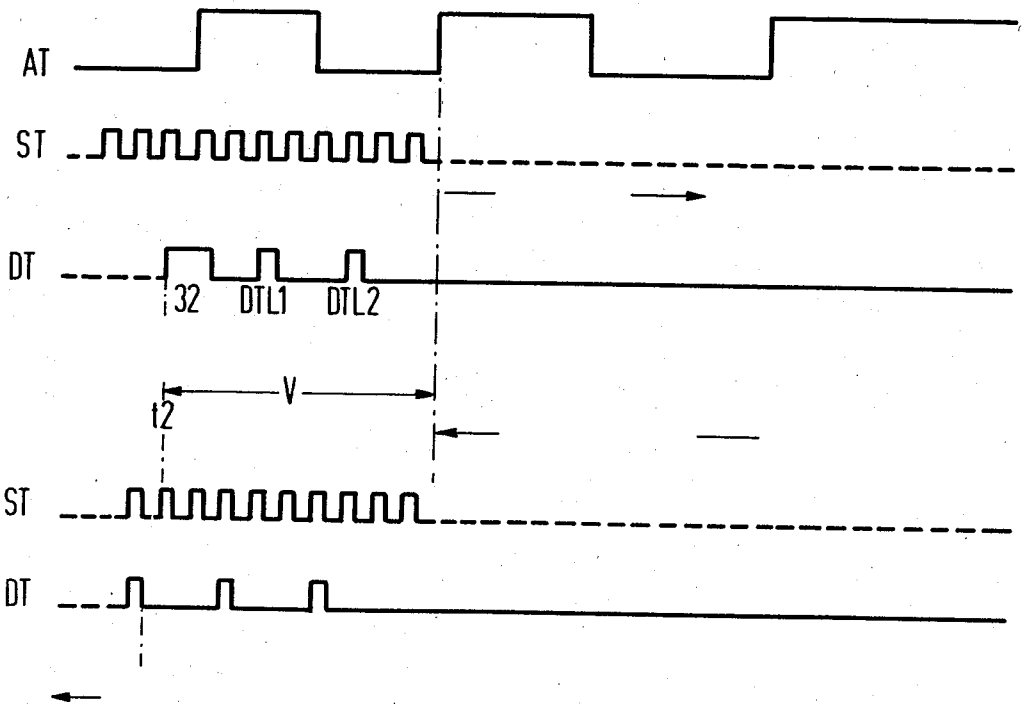
FIG. 2 is a graph showing print clocks with dummy print clock signals inserted in accordance with the present invention.

Referring now to FIG. 2, which illustrates the timing of an embodiment of the present invention, the scan clocks AT are again shown in the top line, with the control clocks ST and the print clocks DT are also shown. FIG. 2 illustrates the region of the last print clock. In accordance with the terminology used in connection with FIG. 1, the last real print clock DT32 appears at time t2. Following the last real print clock DT32, two additional dummy print clocks DTL1 and DTL2 are produced, as shown. In practice, this means that the start of the braking phase is delayed by a definite delay time v. The last of the print clocks, namely the print clock DTL2 has an adequately large spacing relative to the leading edge of the leading or following scan clock AT, in order guarantee a certain execution of the initiation of braking operation.

After the deceleration of the printer carriage, and reversal of the direction of motion thereof, the dummy clocks are likewise taken into consideration. When the printer carriage reaches printing speed, then the previously attached dummy print clocks DTL1 and DTL2 are first inserted again, so that printing the return direction begins at the location at which the last character of the preceding line had been printed. This eliminates offset between successive lines.

The attachment of one or more dummy print clocks not only enables the compensation of deviations in the control and print clock timing, but it is also possible to compensate for influences which can alter the timing of the scan clocks.

Figure 3:
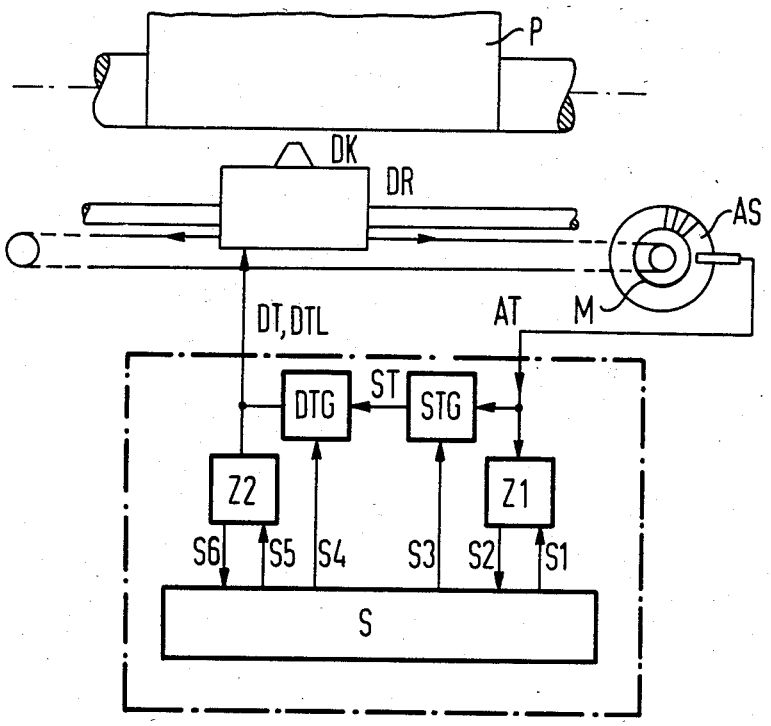
FIG. 3 is a functional block diagram of an embodiment of the present invention.

FIG. 3 illustrates a functional block diagram of an apparatus incorporating an exemplary embodiment of the present invention. A printer carriage DR has a print head DK and is bidirectional in front of the recording medium P. The drive system for the printer carriage DR consists of the motor M which is reversable in direction. The drive system has a sensing means AS in the form of a timing disk having light transmitting regions and opaque regions which are sensed by optical electronic means. The scan clocks AT formed in this fashion represent the information required for the identification of motion of the printer carriage. The generation of the control clocks ST and the print clocks DT is performed in manner known per se by means of a counter and clock generator units. Specifically, a first counter Z1 receives the scan clocks AT. A control clock and a generator STG also receives the scan clocks AT, and produces the control clock ST. The control clock generator STG may incorporate a PLL circuit. The higher frequency control clock ST is connected to a print clock generator DTG, which produces the actual print clocks DT. These are supplied to second counter Z2, which counts off the print clocks DT and recognizes the last print clock DT32, by arriving at the count of 32. The counter Z1 and Z2, as well as the print clock generator DTG, exchange appropriate control data S1-S6 with a control unit S.

The control unit S corresponds to the following control criteria. At the beginning of the motion of the printer carriage DR, the control signal S1 is forwarded to the counter Z1 which begins counting in response to the control signal S1, and counts the scan clocks AT required for the acceleration of the printer carriage. When the printer carriage has reached the prescribed speed, that is, when the counter Z1 has reached a predetermined count state, then the control signal S2 is forwarded to the control unit S. In response to the signal S2, the control clock generator STG and the print clock generator DTG are switched on by control signals S3 and S4, and the second counter Z2 is also switched on by means of the control signal S5. Thereafter, the print clock generator DTG forms a print clock DT by dividing the rate of the control clock ST, in accordance with the structure and operating mode of the dot-matrix printer. When the counter Z2 recognizes the last print clock DT32 of the line by arriving at the count 32, it produces a control signal S6 which is supplied to the control unit S. The control unit S then responds by shutting down the control clock generator STG and the print clock generator DTG, but not before one or more dummy clocks DTL1, DTL2, have been produced by the print clock generator DTG. By this means, the shut down of the counter Z1 and the print clock generator DTG is delayed. The dummy print clocks however do not lead to an impression on the recording medium. After a predetermined number of such dummy print clocks are produced, the control unit S disconnects the control signal S3, to disable the control clock generator STG, and reconnects the control signal S1 to start the counter Z1. Print clocks are thereafter no longer output, but the counter Z1 resumes counting the scan clocks AT. The braking operation and subsequently renewed accelaration in the return direction are then executed. When the printer carriage DR has again reached the prescribed printing speed, with the content of the counter Z1 again corresponding to the prescribed value, the control signal S2 is output to the control unit S. The control clock generator STG and the print clock generator DTG are actuated by means of the control signals S3 and S4, in order to produce the corresponding number of dummy print clocks, which are forwarded to the print head. After the generation of the prescribed number of dummy print clocks, the counter Z2 is switched on and the print clocks which then follow are interpreted in the print head for the representation of characters and are simultaneously counted in the counter Z2. When the last print clock of the line is again identified (by reaching the count 32) then the above events are again repeated for the next line.

It is apparant that various modifications and additions may be made in the apparatus of the present invention without departing from the essential features of novelty thereof, which are intended to be defined and secured by the appended claims.

What is claimed is:

1. A method for the reduction of printing offset in successive print lines in a bidirectional dot-matrix printer having a sensing element for producing scan clock signals and means for deriving print clock signals from said scan clock signals, comprising the steps of providing at least one further print clock signal at the end of each print line beyond the last print clock signal which corresponds to printing information, initiating the braking of the printer carriage after the last of said further print clocks, and after reaccelerating said print carriage in the opposite direction counting said further print clock cycles before generation of print clocks which are coincident with printed information.

2. The method according to claim 1 including the step of producing a number of dummy print clock signals in accordance with the spacing between the last print clock signal coincident with printed information and the leading edge of the next following scan clock signal.

3. Apparatus for reducing printing offset in successive print lines in a dot-matrix printer having a bidirectional carriage and sensing means for generating the scan clock signals, and means for deriving print clock signals from said scan clock signals, a first counter connected to receive said scan clock signals and to count cycles thereof, and a second counter connected to receive said print clock signals and count cycles thereof, comprising in combination; a control unit connected to said first and second counters, a control clock generator connected to said first counter and to said control unit, and a print clock generator connected to said control clock generator and to said control unit, said control unit producing a first control signal connected to said first counter after the start of movement of the printer carriage, said first counter counting said scan clock signals for defining an acceleration phase of said printer carriage, said first counter providing a control signal to said control unit when a constant printing speed is reached, said control unit producing further control signals for controlling operation of said control clock generator, said print clock generator and said second counter, said second counter providing a control signal to said control unit at the end of each print line after the last printing position of a line has been reached, said control unit responding to said control signal from said second counter for disabling said control clock generator, said print clock generator, and said first counter after a predetermined interval.

4. Apparatus according to claim 3 wherein said predetermined interval corresponds to the time required for said print clock generator to produce one further print clock signal.

* * * * *